US008616664B2

(12) United States Patent
Hightower

(10) Patent No.: US 8,616,664 B2
(45) Date of Patent: Dec. 31, 2013

(54) INSET UNDERMOUNTED BRACKET FOR DRAWER AND TRAY SLIDES IN CABINETRY

(75) Inventor: Robert C. Hightower, High Point, NC (US)

(73) Assignee: Tenn-Tex Plastics, Inc., Colfax, NC (US)

( * ) Notice: Subject to any disclaimer, the term of this patent is extended or adjusted under 35 U.S.C. 154(b) by 197 days.

(21) Appl. No.: 12/468,276

(22) Filed: May 19, 2009

(65) Prior Publication Data

US 2010/0295432 A1 Nov. 25, 2010

(51) Int. Cl.
*A47B 88/00* (2006.01)

(52) U.S. Cl.
USPC ..... 312/334.5; 312/334.6; 248/200; 248/300

(58) Field of Classification Search
USPC ..... 211/26; 248/200, 220.21, 250, 300; 312/330.1, 334.4, 334.5, 334.6, 334.7, 312/334.8, 350; 384/22
See application file for complete search history.

(56) References Cited

U.S. PATENT DOCUMENTS

| | | | | |
|---|---|---|---|---|
| 1,702,937 | A | 2/1929 | Friedemann | |
| 2,620,251 | A * | 12/1952 | Restivo | 312/240 |
| 2,739,028 | A * | 3/1956 | Siggia | 312/334.46 |
| 2,843,444 | A * | 7/1958 | Nelson | 312/330.1 |
| 3,090,662 | A | 5/1963 | Dargene | |
| 3,119,643 | A | 1/1964 | Levi et al. | |
| 3,139,313 | A | 6/1964 | Rule | |
| 3,375,051 | A * | 3/1968 | Andersen | 384/19 |
| 3,658,399 | A | 4/1972 | Vogt | |
| 3,675,883 | A | 7/1972 | Holmes et al. | |
| 3,682,524 | A * | 8/1972 | Starace | 312/334.23 |
| 3,750,993 | A | 8/1973 | Read | |
| 3,825,310 | A | 7/1974 | Roemer | |
| 3,846,001 | A | 11/1974 | Kaplan et al. | |
| 3,913,998 | A | 10/1975 | Ley | |
| 3,973,814 | A * | 8/1976 | Entrikin | 312/333 |
| 3,980,364 | A * | 9/1976 | Entrikin et al. | 312/334.18 |
| 4,061,375 | A | 12/1977 | Mertes | |
| 4,077,677 | A * | 3/1978 | Sekerich | 384/19 |
| 4,141,525 | A * | 2/1979 | Miller | 248/251 |
| 4,154,492 | A | 5/1979 | Dunning, III | |
| D252,307 | S * | 7/1979 | Hosmer | D6/511 |
| 4,176,890 | A | 12/1979 | Gorton | |

(Continued)

FOREIGN PATENT DOCUMENTS

| | | |
|---|---|---|
| EP | 0 791 313 A | 8/1997 |
| GB | 1 221 763 | 2/1971 |
| JP | 03166484 A | 7/1991 |
| JP | 2001204565 | 5/2001 |

OTHER PUBLICATIONS

Partial European Search Report EP 03 01 0602 (2003).

*Primary Examiner* — Joshua Rodden
(74) *Attorney, Agent, or Firm* — Myers Bigel Sibley & Sajovec, P.A.

(57) ABSTRACT

A bracket for mounting a sliding drawer or tray to a frame includes: a main panel; a front panel connected and generally normal to the main panel; a floor panel connected and generally normal to the main panel; a front lip connected to the front panel and extending generally parallel to the main panel; and a floor lip connected to the front panel and extending generally parallel to the main panel. In this configuration, the bracket can facilitate precise but simple mounting of the drawer.

9 Claims, 7 Drawing Sheets

(56) References Cited

U.S. PATENT DOCUMENTS

| | | | | | |
|---|---|---|---|---|---|
| 4,199,200 | A | * | 4/1980 | Livingston | 384/19 |
| 4,278,309 | A | * | 7/1981 | Dreiling | 384/22 |
| 4,289,290 | A | * | 9/1981 | Miller | 248/251 |
| 4,348,063 | A | * | 9/1982 | Chambers | 384/18 |
| 4,387,942 | A | | 6/1983 | Lense | |
| 4,453,790 | A | * | 6/1984 | Cohen et al. | 312/334.7 |
| 4,575,164 | A | * | 3/1986 | Pinnow et al. | 312/350 |
| 4,681,381 | A | | 7/1987 | Sevey | |
| 4,741,628 | A | | 5/1988 | Kinley | |
| 4,881,826 | A | * | 11/1989 | Grass | 384/19 |
| 4,930,738 | A | | 6/1990 | Lombardo | |
| 5,039,181 | A | | 8/1991 | Lautenschlager | |
| 5,275,483 | A | | 1/1994 | Rasmussen | |
| 5,306,080 | A | * | 4/1994 | Lautenschlager et al. | 312/334.5 |
| 5,310,255 | A | | 5/1994 | Ranallo | |
| 5,370,454 | A | | 12/1994 | Domenig | |
| 5,372,417 | A | | 12/1994 | Buie et al. | |
| 5,387,033 | A | * | 2/1995 | Domenig | 312/334.5 |
| 5,457,867 | A | | 10/1995 | Maberry et al. | |
| 5,549,376 | A | | 8/1996 | Domenig | |
| 5,570,941 | A | * | 11/1996 | Rock et al. | 312/334.6 |
| 5,597,220 | A | * | 1/1997 | Domenig et al. | 312/334.4 |
| 5,601,350 | A | * | 2/1997 | Rock et al. | 312/334.1 |
| 5,636,820 | A | * | 6/1997 | Domenig | 248/220.21 |
| 5,658,059 | A | * | 8/1997 | Rock et al. | 312/334.6 |
| 5,746,490 | A | | 5/1998 | Domenig | |
| 5,823,648 | A | | 10/1998 | Domenig | |
| 5,833,337 | A | | 11/1998 | Kofstad | |
| 5,842,759 | A | | 12/1998 | Ferrari et al. | |
| 5,876,103 | A | * | 3/1999 | Domenig | 312/334.4 |
| 5,890,784 | A | | 4/1999 | Domig | |
| 5,904,412 | A | | 5/1999 | Lammens | |
| 6,010,200 | A | | 1/2000 | Hays | |
| 6,070,957 | A | | 6/2000 | Zachral | |
| 6,155,660 | A | | 12/2000 | Nicolai | |
| 6,196,141 | B1 | | 3/2001 | Herron et al. | |
| 6,230,903 | B1 | | 5/2001 | Abbott | |
| 6,270,281 | B1 | | 8/2001 | Ruusuvuori | |
| 6,273,534 | B1 | | 8/2001 | Bueley et al. | |
| 6,367,900 | B1 | | 4/2002 | Woerner | |
| 6,373,707 | B1 | | 4/2002 | Hutchins | |
| 6,374,649 | B1 | | 4/2002 | Holcomb et al. | |
| 6,390,576 | B1 | * | 5/2002 | Walburn | 312/348.4 |
| 6,402,276 | B1 | | 6/2002 | King | |
| 6,422,399 | B1 | | 7/2002 | Castillo et al. | |
| 6,431,668 | B1 | | 8/2002 | Reddicliffe | |
| 6,494,550 | B1 | | 12/2002 | Chen et al. | |
| 6,494,551 | B1 | | 12/2002 | Markley | |
| 6,578,939 | B1 | * | 6/2003 | Mayer | 312/334.5 |
| 6,615,992 | B1 | | 9/2003 | Lauchner et al. | |
| 6,681,942 | B2 | * | 1/2004 | Haney | 211/183 |
| 6,702,124 | B2 | * | 3/2004 | Lauchner et al. | 211/26 |
| 6,733,098 | B1 | * | 5/2004 | Branson | 312/352 |
| 6,736,277 | B2 | | 5/2004 | Lauchner et al. | |
| 6,757,937 | B2 | * | 7/2004 | Salice | 16/94 R |
| 6,837,557 | B2 | * | 1/2005 | Domenig | 312/334.34 |
| 6,881,900 | B2 | * | 4/2005 | Halbert | 174/58 |
| 7,201,279 | B1 | | 4/2007 | Mimlitch et al. | |
| 8,079,654 | B2 | | 12/2011 | Yu et al. | |
| 2003/0071547 | A1 | * | 4/2003 | Domenig | 312/334.4 |
| 2004/0104651 | A1 | * | 6/2004 | Kreft et al. | 312/334.5 |
| 2005/0052102 | A1 | * | 3/2005 | Lauchner | 312/334.5 |
| 2005/0155941 | A1 | * | 7/2005 | Hartman et al. | 211/26 |
| 2005/0156493 | A1 | * | 7/2005 | Yang et al. | 312/334.5 |
| 2007/0175835 | A1 | * | 8/2007 | Liang | 211/26 |
| 2008/0134620 | A1 | * | 6/2008 | Contasti | 52/712 |
| 2009/0166485 | A1 | | 7/2009 | Chen et al. | |

* cited by examiner

INSET UNDERMOUNTED BRACKET FOR DRAWER AND TRAY SLIDES IN CABINETRY

FIELD OF THE INVENTION

The present invention is directed generally to furniture, and more particularly to cabinets with sliding drawers and trays.

BACKGROUND OF THE INVENTION

Many cabinets, particularly those found in kitchens, include drawers for storing various items. Often, drawers are mounted to the cabinet with elongate slide members that are fixed to the drawer. Each slide member slidably engages a second elongate slide member that is fixed to the walls of the cabinet (often one of the slide members includes a small wheel that facilitates sliding motion). Some of such cabinets include multiple drawers, which can be disposed in vertically stacked fashion, side-by-side fashion, or both.

Some drawers have slides that are mounted on the underside of the drawer (so-called "undermounted" drawer slides). These drawer slides may be preferred in some environments because they are less exposed than side-mounted drawer slides (and therefore may be less exposed to damage) and may avoid taking up space on either side of the drawer. In some embodiments, undermounted slides may have mechanisms that cause the drawer to close automatically without slamming. An exemplary undermounted drawer slide is the DYNAMIC NT slide, available from Mepla-Alfit, Reinheim, Germany; another is illustrated in U.S. Pat. No. 6,854,817 to Simon.

An undermounted drawer slide may be mounted to a side wall of the cabinet, or may be mounted at either end to the front or rear wall. If the slide is to be mounted to the front or rear wall, often the wall will include mounting holes for receiving screws or other fasteners inserted through a mounting bracket that connects to the slide. However, the tolerances of cabinets and drawer slides are typically insufficiently precise to consistently position the holes in the mounting bracket for easy mounting of the drawer slide. Also, some currently popular cabinets have drawers that are configured such that, when the drawer is closed, the front face of the drawer is substantially flush with the front face of the cabinet. In such instances, it is typically desirable that the drawer be mounted precisely to ensure the flush relationship of the drawer face and cabinet face. However, achieving a flush relationship may be difficult due to inconsistencies in the thickness of the drawer face, the length of the cabinet and drawer slides, and the thickness of the front wall of the cabinet.

In view of the foregoing, it may be desirable to provide a mounting technique that addresses these difficulties.

SUMMARY OF THE INVENTION

As a first aspect, embodiments of the present invention are directed to a bracket for mounting a sliding drawer or tray to a frame. The bracket comprises: a main panel; a front panel connected and generally normal to the main panel; a floor panel connected and generally normal to the main panel; a front lip connected to the front panel and extending generally parallel to the main panel; and a floor lip connected to the front panel and extending generally parallel to the main panel. In this configuration, the bracket can facilitate precise but simple mounting of the drawer.

As a second aspect, embodiments of the present invention are directed to a cabinet with a sliding drawer or tray, comprising: a front face having a cutaway area defined by a front edge and a lower edge; a mounting bracket; and a drawer slide mounted to the mounting bracket. The mounting bracket comprises: a main panel; a front panel connected and generally normal to the main panel; a floor panel connected and generally normal to the main panel; a front lip connected to the front panel and extending generally parallel to the main panel, the front lip overlying the front edge of the front face cutaway area; and a floor lip connected to the front panel and extending generally parallel to the main panel, the floor lip overlying the lower edge of the front face cutaway area.

As a third aspect, embodiments of the present invention are directed to a bracket for mounting a sliding drawer or tray to a frame, comprising: a main panel; a front panel connected and generally normal to the main panel; a floor panel connected and generally normal to the main panel; a front lip connected to the front panel and extending generally parallel to the main panel; and a floor lip connected to the front panel and extending generally parallel to the main panel. The main panel includes a slot that is generally parallel with the floor panel, and a fastener receiving member is configured to slide relative to the slot. An inner surface of the main panel is inset from an inner surface of the front lip, and an upper surface of the floor panel is inset from an upper surface of the front lip.

DETAILED DESCRIPTION OF EMBODIMENTS OF THE INVENTION

Figure 1:
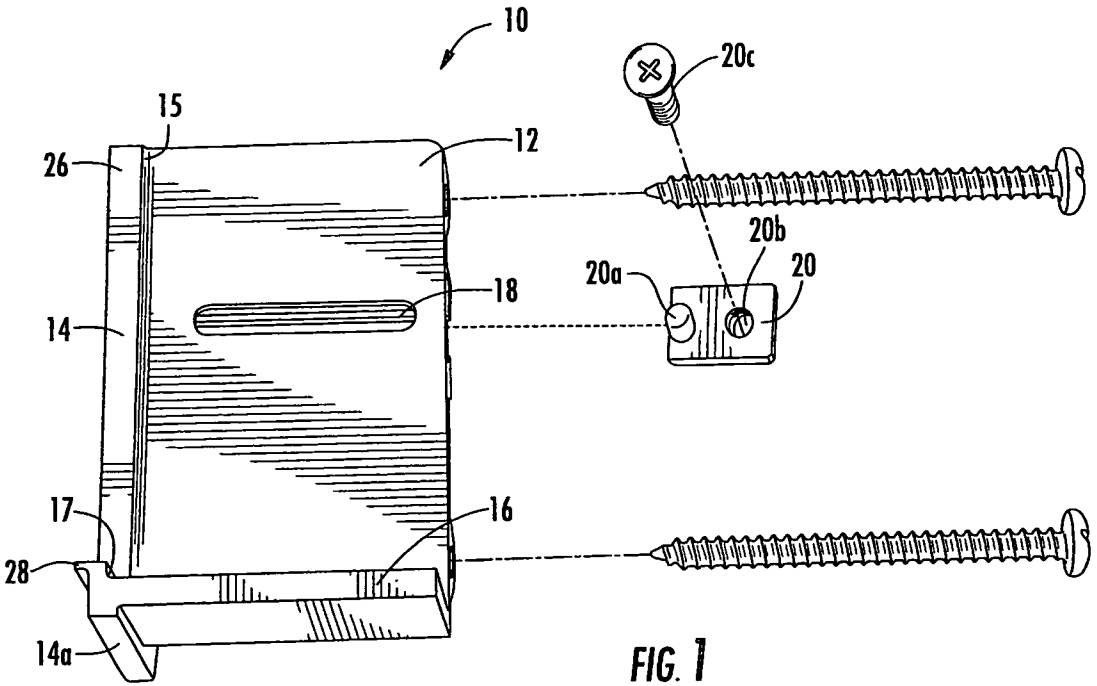
FIG. 1 is an exploded rear perspective view of a mounting bracket and mounting screws in accordance with embodiments of the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

Figure 2:
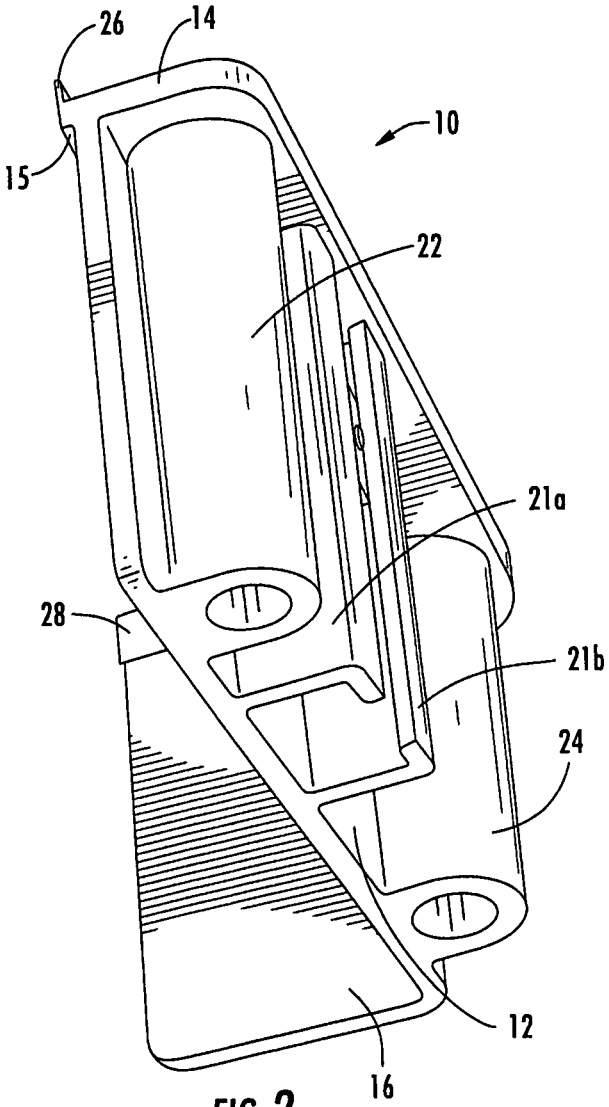
FIG. 2 is a top perspective view of the mounting bracket of FIG. 1.

Referring now to the figures, a mounting bracket, designated broadly at 10, is illustrated in FIGS. 1 and 2. The bracket 10 includes a main panel 12, a floor panel 16 that is attached to the lower edge of the main panel 12 and extends generally normal thereto, and an L-shaped front panel 14 with a leg 14*a*; the front panel 14 is attached to the front edged of the main panel 12 and leg 14*a* is attached to the floor panel 16 and extends generally normal thereto. As can be seen in FIGS. 1 and 2, the main panel 12 is recessed slightly, such that an elongate bearing surface 15 is formed with the front panel 14. Also, the floor panel 16 is slightly recessed such that a bearing surface 17 is formed with the front panel 14.

The bracket 10 also includes a vertically-oriented front lip 26 that extends forwardly from the front panel 14 generally parallel to the main panel 12 but slightly offset therefrom; the offset is typically between about 0.001 and 0.150 inches. The bracket 10 further includes a horizontally-oriented floor lip 28 that extends forwardly from the upper edge of the front panel leg 14*a*.

The main panel 12 includes a horizontally-oriented slot 18. A sliding nut 20 has a pin 20*a* that is received in the slot 18. The sliding nut 20 also includes an aperture 20*b* that receives a bolt 20*c*. The nut is received in a horizontal channel formed L-shaped by arms 21*a*, 21*b* that extend from the main panel 12. In addition, upper and lower bosses 22, 24 extend horizontally along the main panel 12.

The bracket 10 is typically formed of a polymeric material, such as acetal, but may be formed of any material that is suitably rigid and rugged for use in a cabinet environment. The bracket 10 is typically constructed such that the aforementioned components (with the exception of the sliding nut 20) are formed as a unitary member. In some embodiments, the bracket 10 will be formed via injection molding.

Figure 3:
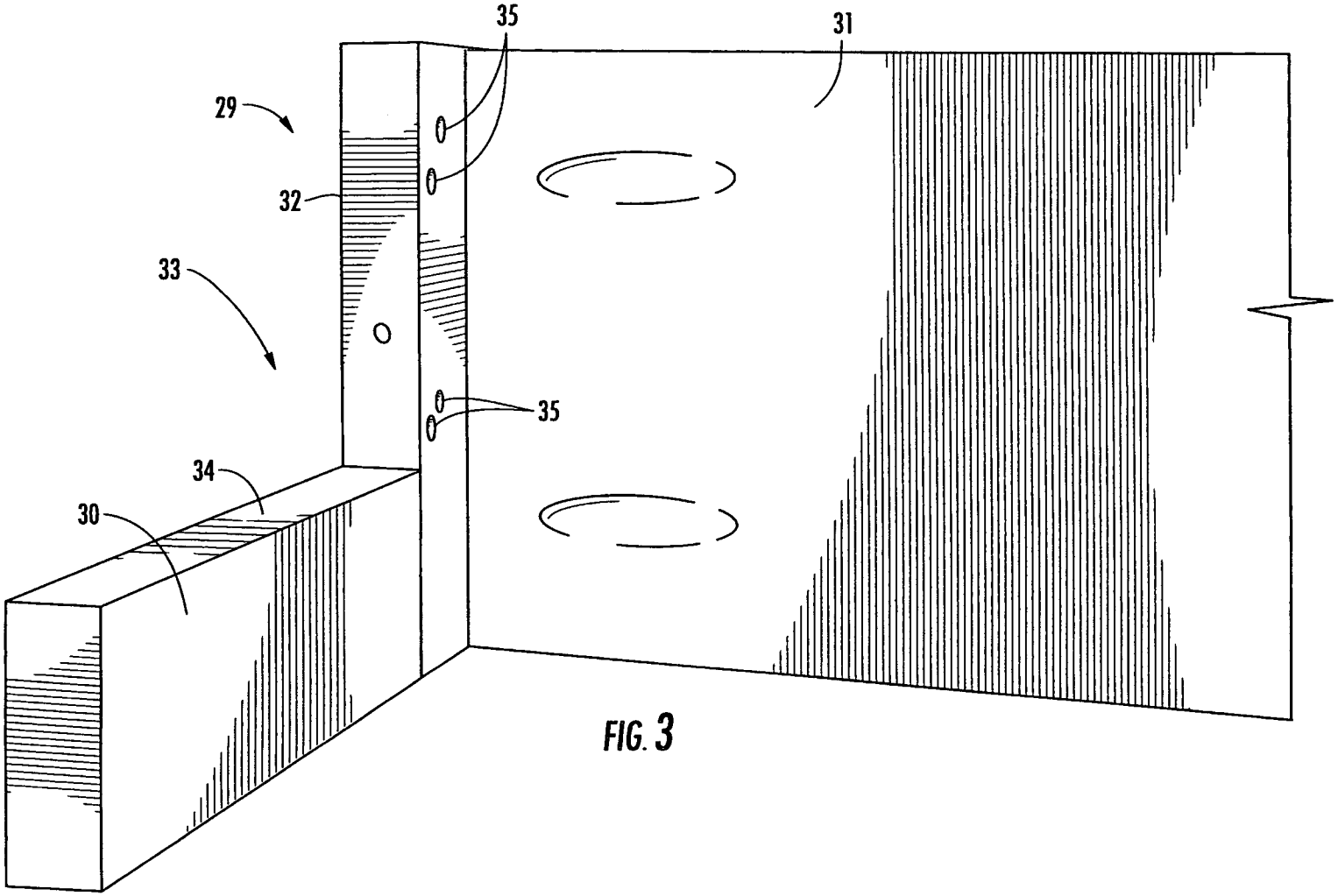
FIG. 3 is a rear perspective view of the front face and sidewall of a cabinet.

The use of the mounting bracket 10 can be understood with reference to FIGS. 3-7. FIG. 3 illustrates a cabinet 29 having a front face 30 and a side wall 31 fixed normal to each other. The front face 30 has a cut-out area 33 that receives the front face of a drawer (not shown). The cut-out area is lined by a side edge 32 and a lower edge 34 that are disposed generally perpendicular to each other. Also, on its rear surface the front face 30 has apertures 35 for mounting of the mounting bracket 10.

Figure 4:
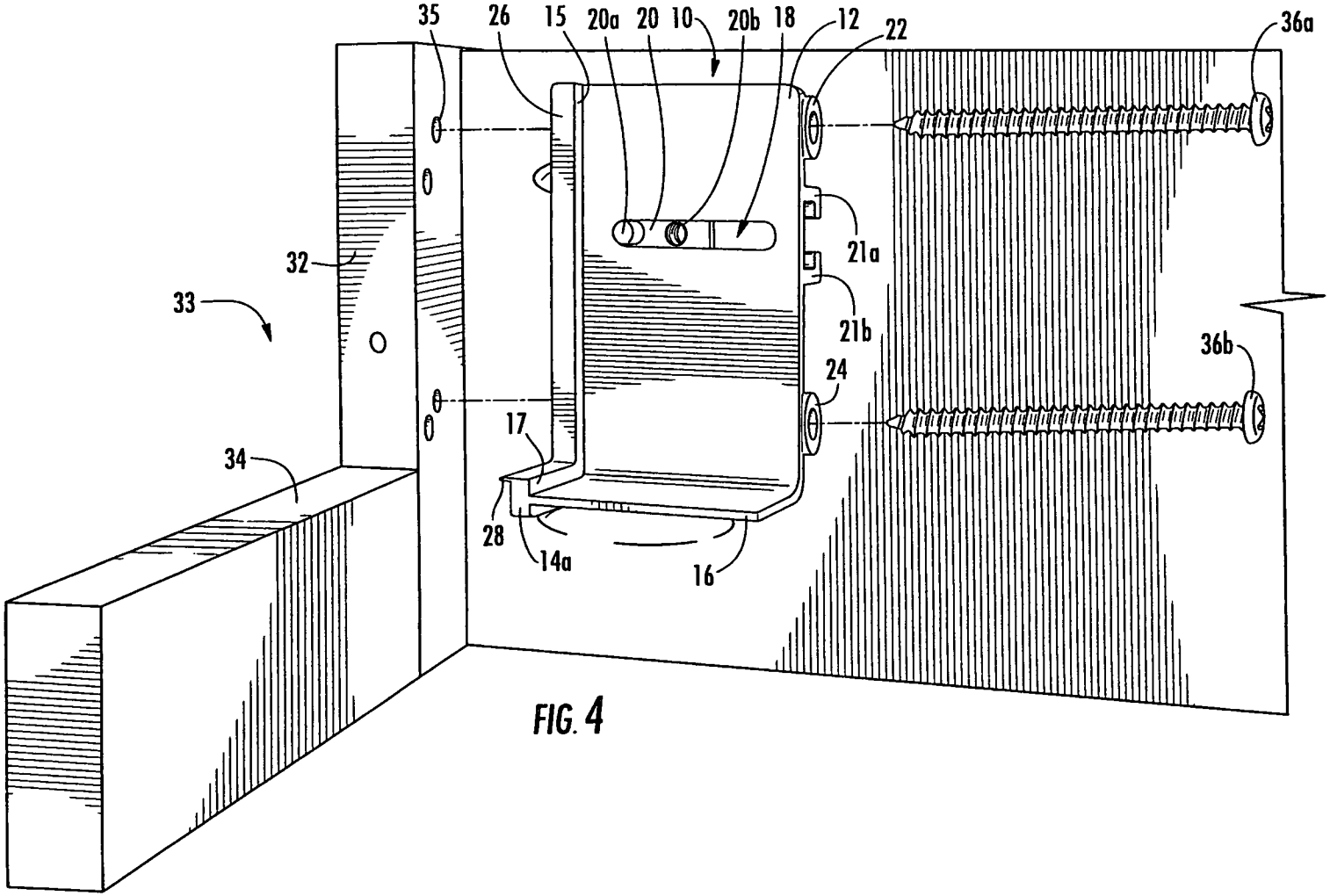
FIG. 4 is a rear perspective view of the cabinet of FIG. 3 and the mounting bracket of FIG. 1 showing the mounting of the mounting bracket via screws.
Figure 5:
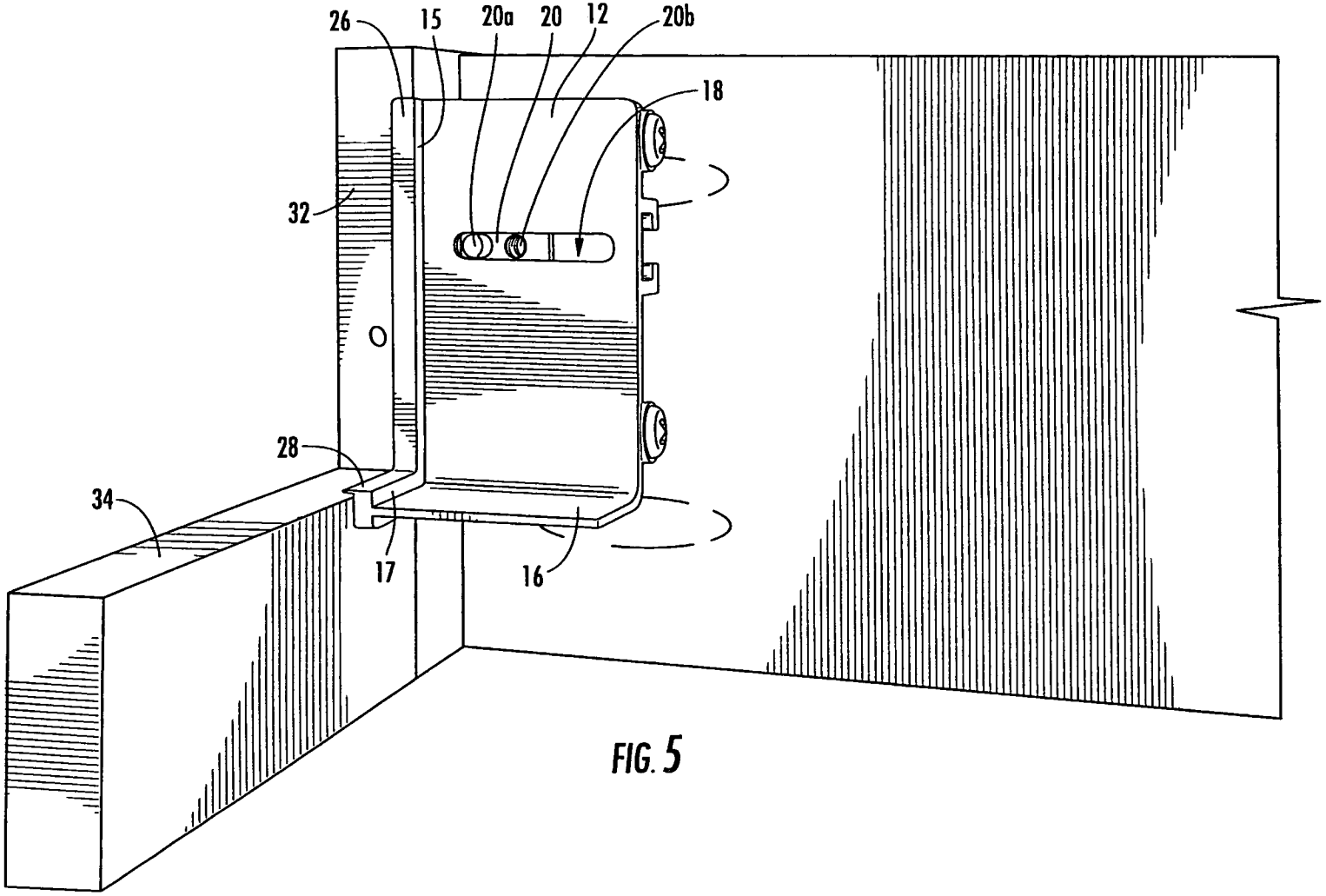
FIG. 5 is a rear perspective view of the cabinet and mounting bracket of FIG. 4 showing the mounting bracket mounted in position.

As can be seen in FIGS. 4 and 5, the mounting bracket 10 can then be mounted on the front face 30 via the insertion of screws 36*a*, 36*b* through the upper and lower bosses 22, 24 and into the apertures 35. When mounted, the floor lip 28 of the mounting bracket 10 contacts and overlies the lower edge 34 of the cutaway area 33, and the front lip 26 of the mounting bracket 10 contacts and overlies the side edge 32 of the cutaway area 33, such that the corner formed by the floor lip 28 and the front lip 26 is wedged into the corner formed by the floor edge 34 and the side edge 32. In this position, it can be seen in FIG. 5 that the floor panel 16 is positioned slightly below the level of the lower edge 34, and the main panel 12 is positioned slightly outwardly from the side edge 32. Because the bracket 10 is fixed into the corner of the cutaway area, its position is repeatable and predictable.

It can also be seen in FIGS. 4 and 5 that the sliding nut 20 is positioned in the channel formed by the arms 21*a*, 21*b*, with the pin 20*a* inserted into the slot 18 of the main panel 12. This arrangement positions the aperture 20*b* so that it confronts the slot 18.

Figure 6:
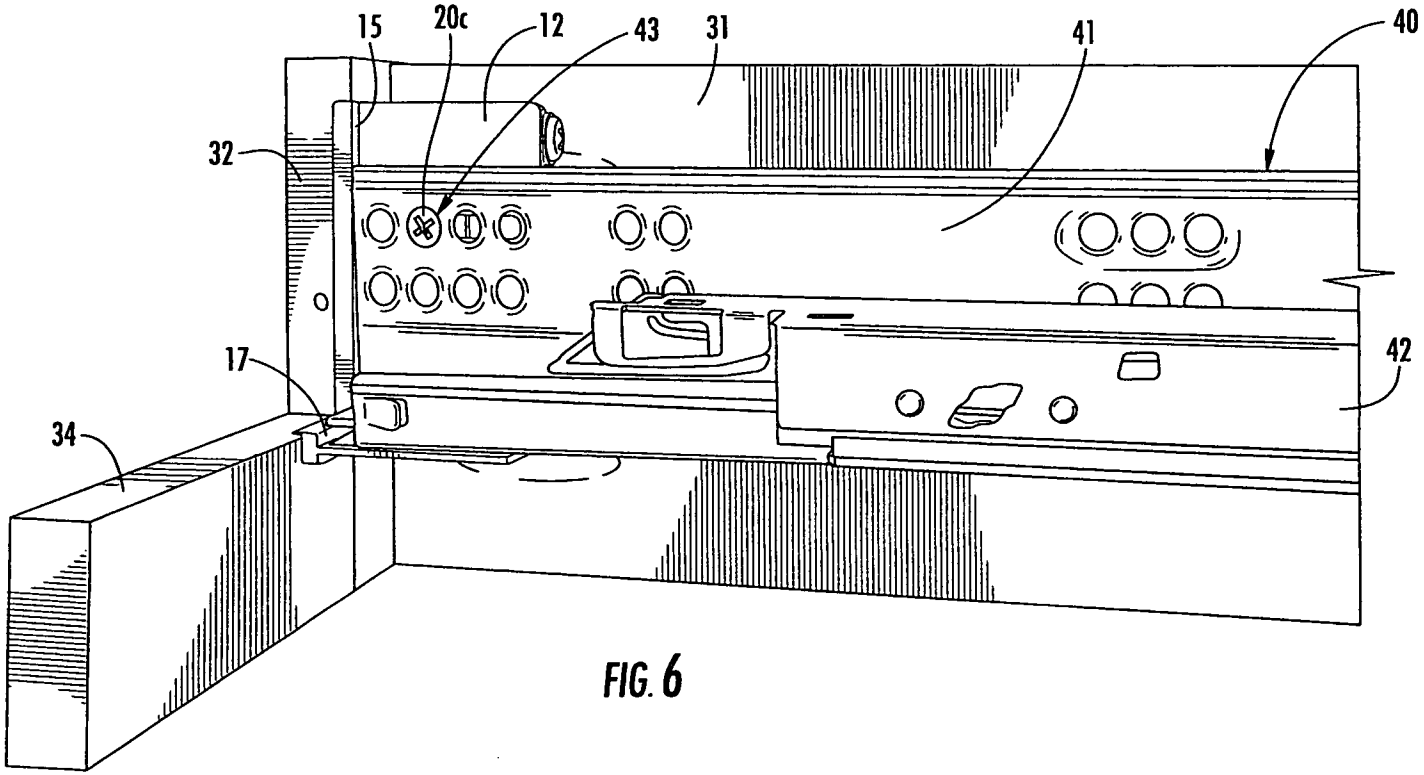
FIG. 6 is a rear perspective view of the cabinet and mounting bracket of FIG. 4 showing the attachment of an undermounted drawer slide to the mounting bracket.
Figure 7:
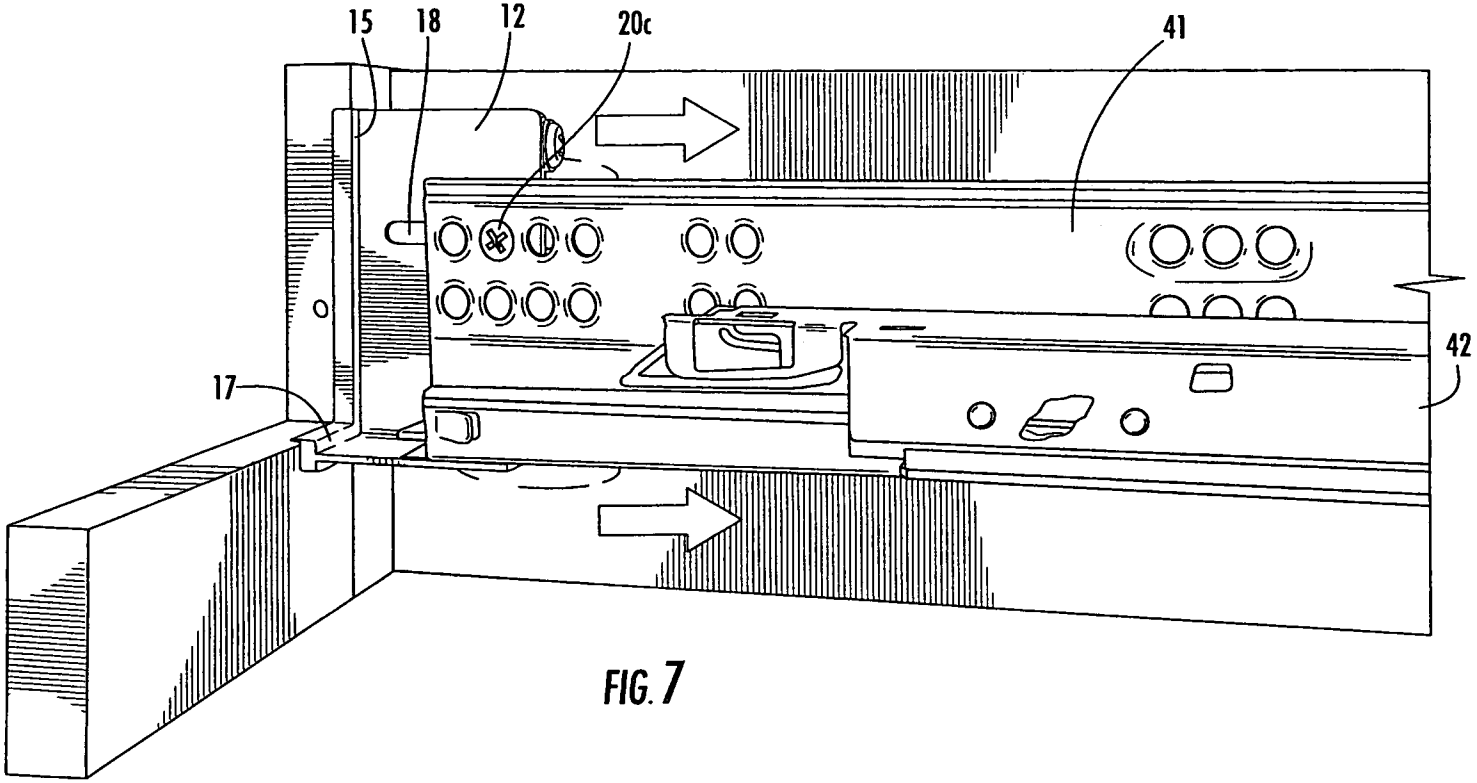
FIG. 7 is a rear perspective view of the cabinet, mounting bracket and drawer slide of FIG. 6 showing how the drawer slide can be adjusted rearwardly as needed.

Referring now to FIG. 6, an undermounted drawer slide 40 can be attached to the mounting bracket 10. The drawer slide 40 includes a side rail 41 and a lower rail 42 that is slidably mounted on the side rail 41. The lower rail 42 is mounted to the underside of a drawer (not shown). During installation, the side rail 41 can be mounted to the cabinet via the bracket 10 by inserting the bolt 20*c* through a hole 43 in the side rail 41, through the slot 18 in the main panel 12 of the mounting bracket 10, and into the aperture 20*b* of the sliding nut 20. Tightening the bolt 20*c* within the sliding nut 20 fixes the position of the side rail 41 relative to the side wall 31 of the cabinet.

Notably, the fore-and-aft position of the sliding nut 20 can adjusted within the slot 18 by sliding the sliding nut 20 therein before tightening, which in turn can enable the fore-and-aft position of the side rail 41 to be adjusted. The adjustability can be seen by comparing FIG. 6, in which the side rail 41 is mounted in a fully forward position, with the front edges of the side rail 41 abutting the bearing surfaces 15, 17 of the mounting bracket 10, with FIG. 7, in which the front edges of the side rail 41 are spaced apart from the bearing surfaces 15, 17. In some embodiments, the fore-and-aft position of the side rail 41 may be adjusted by as much as 0.5 inch or more. This degree of adjustability can enable the rail 41 to be positioned precisely despite variations in manufacturing tolerances in the side rail, the cabinet, and the drawer.

It should also be noted that the inset or recess of the main panel 12 from the front lip 26 and the inset/recess of the floor panel 16 from the floor lip 28 enable the side rail 41 to be mounted in a position in which it will not interfere with operation of the drawer or reduce the amount of space available (particularly in the transverse direction) for an undermounted drawer. Typically the amount of inset or recess is between about 0.001 and 0.150 inch, which is at least as much or more than the thickness of the material that forms the side rail 41.

Those skilled in this art will appreciate that other variations for the mounting bracket may be employed. For example, the sliding nut may take various configurations, including one in which the entire nut or other fastener receiving member slides within a slot and is non-circular to prevent unwanted rotation within the slot during bolt tightening. The magnitude of inset/recess of either or both of the front and floor panels may be increased or decreased as desired. The bracket may be attached to the front wall via staples or other fasteners and, as such, included structure suitable for receiving such fasteners. The degree of adjustability of the bracket may be varied with an increase or decrease in the length of the slot. Other means, such as clamps or the like, may be employed to fix the sliding nut within the slot. Other variations will be apparent to those skilled in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A cabinet with a sliding drawer or tray, comprising:

a front face having a cutaway area defined by a side edge and a lower edge, the lower edge being generally perpendicular to the side edge;

a mounting bracket mounted to a rear surface of the front face and comprising:

a main panel;

a front panel connected and generally perpendicular to the main panel;

a floor panel connected and generally perpendicular to the main panel and to the front panel;

a first lip connected to the front panel and extending forwardly and generally parallel to the main panel, the first lip overlying and in contact with the side edge of the front face cutaway area; and a second lip connected to the front panel and extending forwardly and generally parallel to the floor panel, the second lip overlying and in contact with the lower edge of the front face cutaway area; and a drawer slide mounted to the mounting bracket;

wherein an inner surface of the main panel is offset from an inner surface of the first lip to form a first bearing surface; and wherein an upper surface of the floor panel is offset from an upper surface of the second lip to form a second bearing surface;

wherein the front panel is generally L-shaped.

2. The cabinet defined in claim 1, wherein the main panel includes a slot, and wherein a fastener receiving member is configured to slide relative to the slot.

3. The cabinet defined in claim 2, wherein the slot is generally parallel with the floor panel.

4. The cabinet defined in claim 2, wherein the fastener receiving member includes a pin that is received in the slot.

5. The cabinet defined in claim 1, wherein the main panel, the front panel and the floor panel are formed as a unitary member.

6. The cabinet defined in claim 5, wherein the unitary member is formed of a polymeric material.

7. The cabinet defined in claim 1, further comprising a structure adapted for receiving a fastening member for fastening the bracket to the front face of the cabinet.

8. The cabinet defined in claim 7, wherein the structure adapted for receiving a fastening member is a boss.

9. A bracket for mounting a sliding drawer or tray to a frame, comprising:

a main panel;

a front panel directly connected and generally perpendicular to the main panel;

a floor panel directly connected and generally perpendicular to the main panel and to the front panel;

a front lip directly connected to the front panel and extending generally parallel to the main panel; and a floor lip directly connected to the front panel and extending generally parallel to the floor panel;

wherein the main panel includes a slot that is generally parallel with the floor panel, wherein a fastener receiving member is configured to slide relative to the slot;

wherein an inner surface of the main panel is offset from an inner surface of the front lip to form a first bearing surface; and wherein an upper surface of the floor panel is offset from an upper surface of the floor lip to form a second bearing surface;

wherein the front panel is generally L-shaped.

* * * * *